US007040382B2

(12) United States Patent
Hsu

(10) Patent No.: US 7,040,382 B2
(45) Date of Patent: May 9, 2006

(54) END SURFACE CAPILLARY STRUCTURE OF HEAT PIPE

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 84 days.

(21) Appl. No.: 10/883,702

(22) Filed: Jul. 6, 2004

(65) Prior Publication Data

US 2006/0005960 A1 Jan. 12, 2006

(51) Int. Cl.
*F28D 15/00* (2006.01)

(52) U.S. Cl. ..... 165/104.26; 165/104.21

(58) Field of Classification Search ..... 165/104.21, 165/104.26, 133, 185, 80.3; 361/700, 705; 257/715, 714; 174/15.2; 29/890.032
See application file for complete search history.

(56) References Cited

U.S. PATENT DOCUMENTS 4,366,526 A * 12/1982 Lijoi et al. ..... 361/700
5,308,920 A * 5/1994 Itoh ..... 174/15.2
5,412,535 A * 5/1995 Chao et al. ..... 361/700
5,895,868 A * 4/1999 Giammaruti et al. .... 73/863.81
6,466,442 B1 * 10/2002 Lin ..... 361/695
6,793,009 B1 * 9/2004 Sarraf ..... 165/104.33
2003/0140045 A1 * 7/2003 Oh et al. ..... 165/104.26
2003/0183381 A1 * 10/2003 Garner et al. ..... 165/274
2004/0163799 A1 * 8/2004 Connors et al. ..... 165/104.26

FOREIGN PATENT DOCUMENTS

JP 55046331 A * 4/1980

* cited by examiner

*Primary Examiner*—Tho Duong

(57) ABSTRACT

A heat pipe includes a pipe member, a bottom lid and a wick structure. The pipe member includes a plurality of longitudinal grooves radially arranged on an inner sidewall thereof. The bottom lid covers a bottom end of the pipe member. The wick structure includes the grooves and sintered powders attached to an inner surface of the bottom lid. Thereby, the sintered powders does not need to be attached to the inner wall of the pipe member so that an axial bar is no more need. Such that, the damage caused by removal of the axial bar are prevented and the fabricating process of the heat pipe is simplified.

14 Claims, 6 Drawing Sheets

1

END SURFACE CAPILLARY STRUCTURE OF HEAT PIPE

BACKGROUND OF THE INVENTION

The present invention relates in general to an end surface capillary structure of a heat pipe, and more particularly, to a heat pipe that includes an end surface in contact with the heat source and a wick structure including a plurality of grooves and a powder-sintered attachment.

Having the characteristics of high thermal conductivity, fast thermal conduction, light weight, non-movable components and simple structure, heat pipes are able to deliver large amount of heat without consuming electricity, and are therefore commonly used in the market.

FIG. 1 illustrates a conventional heat pipe 1*a* that includes a pipe member 10*a* and a powder-sintered wick structure ha attached to an internal sidewall of the pipe member 10*a*. The wick structure 11*a* provides capillary force to transport working fluid filled in the pipe member 1*a*. However, the fabrication of the wick structure 11*a* requires an axial bar 12*a* inserted into the heat pipe 1*a* for supporting the wick structure ha during powder sintering process to avoid powder collapse. This type of wick structure has the following drawbacks.

1. When the axial bar 2*a* is inserted into the pipe member 10*a* of the heat pipe 1*a*, it is difficult to dispose the axial bar 1*a* along the axis of the pipe member 10*a*. Instead the axial bar 1*a* is easily deviated from the axis to cause non-uniform wick structure 11*a*, such that the fluid transportation is non-uniform to cause poor thermal conduction.

2. After powder sintering process, the powders for forming the wick structure ha are easily attached to the axial bar 12*a* to cause problem for removing the axial bar 12*a* from the pipe member 12*a*. Therefore, the quality of such heat pipe depends on proficiency of the operator, and it cannot be fabricated by mass production.

3. As it is difficult to remove the axial bar 12*a*, external force is required for the removal. However, because an annealing process is performed on the wick structure 11*a* and the pipe member 10*a* before removing the axial bar 12*a*, the heat pipe 1*a* is extremely soft. Therefore, during the removal of the axial bar 12*a*, the pipe member 10*a* is easily deformed and the wick structure 11*a* is easily damaged. Such that the structure precision of the heat pipe 1*a* will be greatly affected.

Therefore, there exist inconvenience and drawbacks for practically application of the above-mentioned conventional heat pipe. There is thus a substantial need to provide an improved end surface capillary structure of a heat pipe that resolves the above drawbacks and can be used more conveniently and practically.

SUMMARY OF THE INVENTION

The present invention provides a heat pipe having an end surface capillary structure serving as a heat absorption portion. According to the heat pipe structure of the present invention, the axial bar is no more needed to fabricate the wick structure. Therefore, the drawback of above-mentioned process is resolved, while the powder-sintered wick structure of the heat pipe provides proper delivery of working fluid.

A heat pipe includes a pipe member, a bottom lid and a wick structure. The pipe member includes a plurality of longitudinal grooves radially arranged on an inner sidewall thereof. The bottom lid covers a bottom end of the pipe member. The wick structure includes the grooves and a powder-sintered attachment formed on an inner surface of the bottom lid. Thereby, the sintered powders does not need to be attached to the inner wall of the pipe member so that there is no more need the axial bar.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF ACCOMPANIED DRAWINGS

The above objects and advantages of the present invention will be become more apparent by describing in detail exemplary embodiments thereof with reference to the attached drawings in which.

DETAILED DESCRIPTION OF EMBODIMENT

Figure 1:
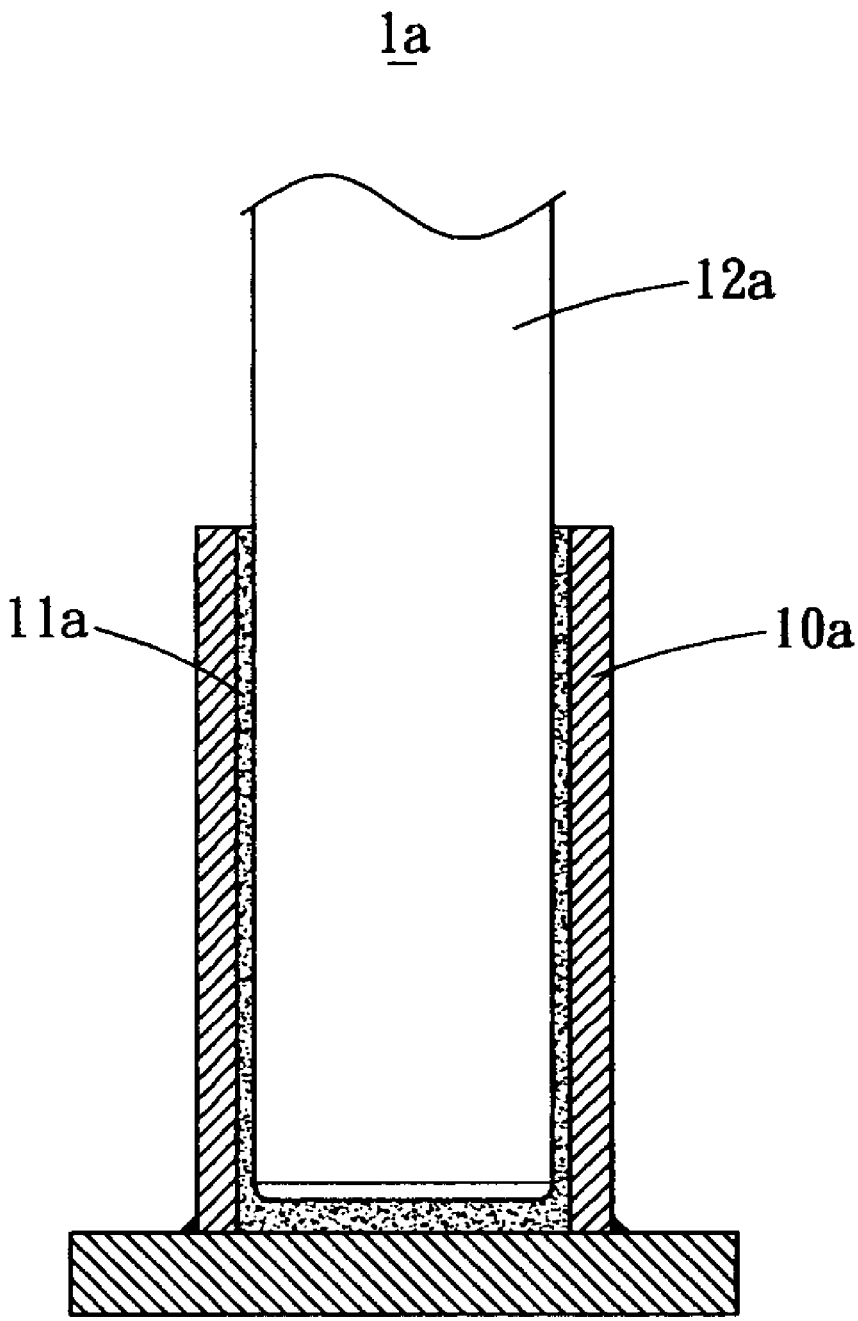
FIG. 1 PRIOR ART
FIG. 1 illustrates a cross sectional view of a conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Figure 2:
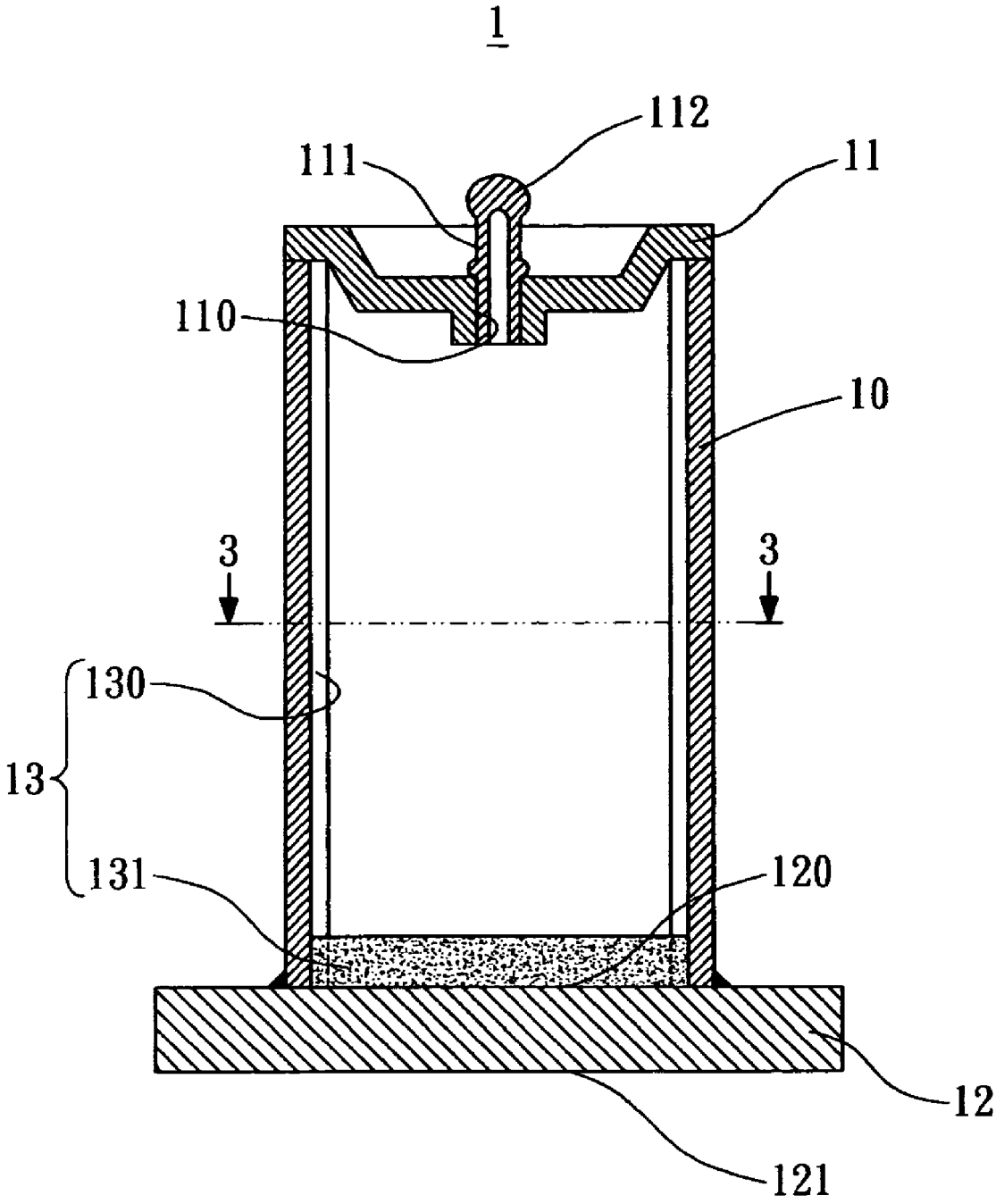
FIG. 2 illustrates a cross sectional view of a heat pipe according to one preferred embodiment of the present invention.

As shown in FIG. 2, a cross sectional view of a heat pipe provided by one embodiment of the present invention is illustrated. The heat pipe 1 includes a pipe member 10, a top lid 11 and a bottom lid 12.

The pipe member 10 is preferably a cylindrical hollow tube with one end covered by the top lid 11 and the other end connected to the bottom lid 12. The top lid 11 has an aperture 110 for receiving a filling tube 111; however in another preferred embodiment, the top lid 11 and the filling tube 111 can be integrally formed. Such that a working fluid can be filled into the pipe member 10 through the filling tube 111. By subsequent process such as vacuum, the aperture 110 is sealed with the sealing structure 112 formed by tin dipping or soldering. The bottom lid 12 can be a flat plate including an inner surface 120 and an external surface 121. The external surface 121 is a planar surface to be contacted with a heat source 2 (as shown in FIG. 6), such that the heat pipe 1 is an end surface absorbing heat pipe.

Figure 3:
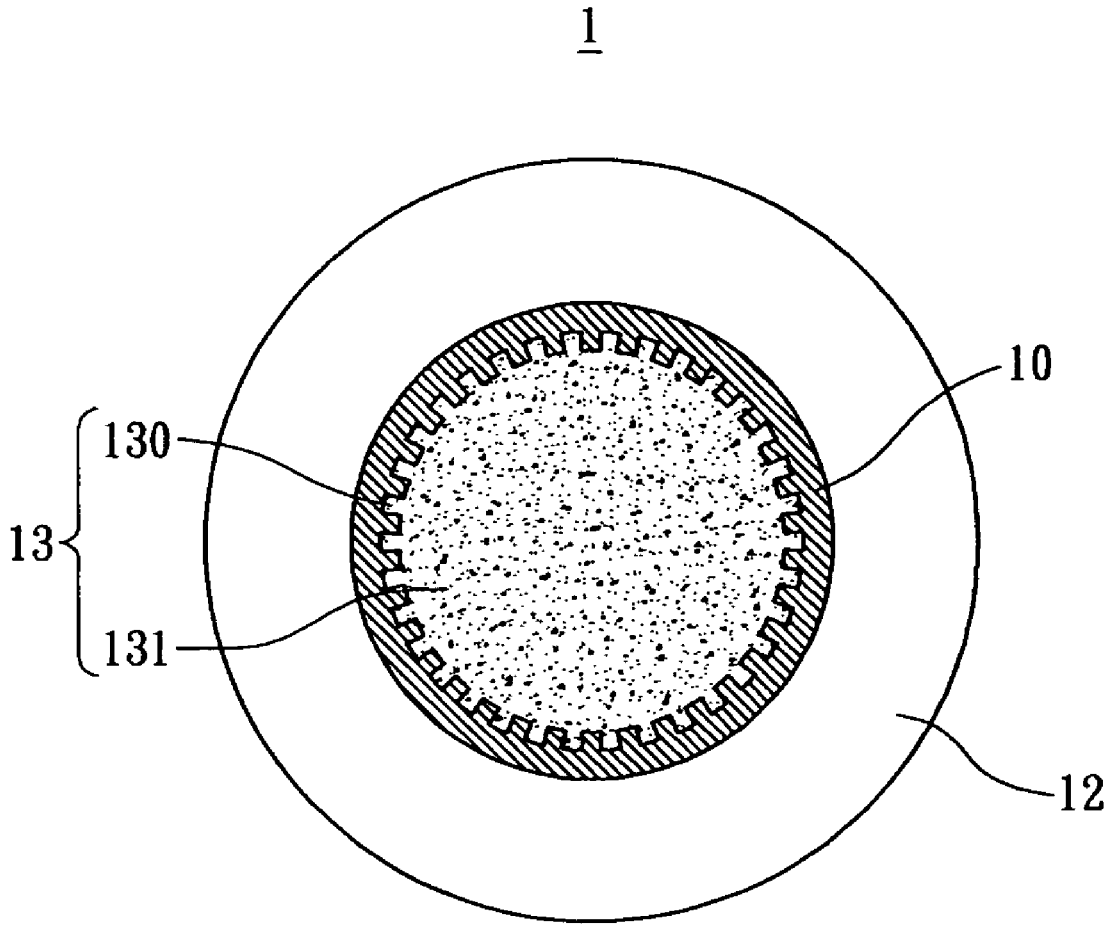
FIG. 3 is a cross sectional view along line 3—3 in FIG. 2 according to one embodiment of the present invention.
Figure 4:
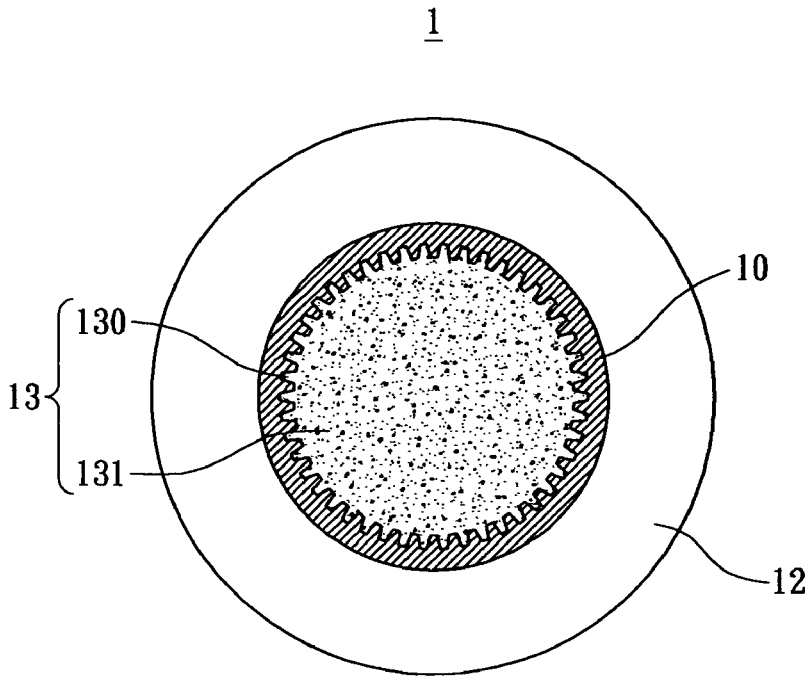
FIG. 4 is a cross sectional view along line 3—3 in FIG. 2 according to another embodiment of the present invention.
Figure 5:
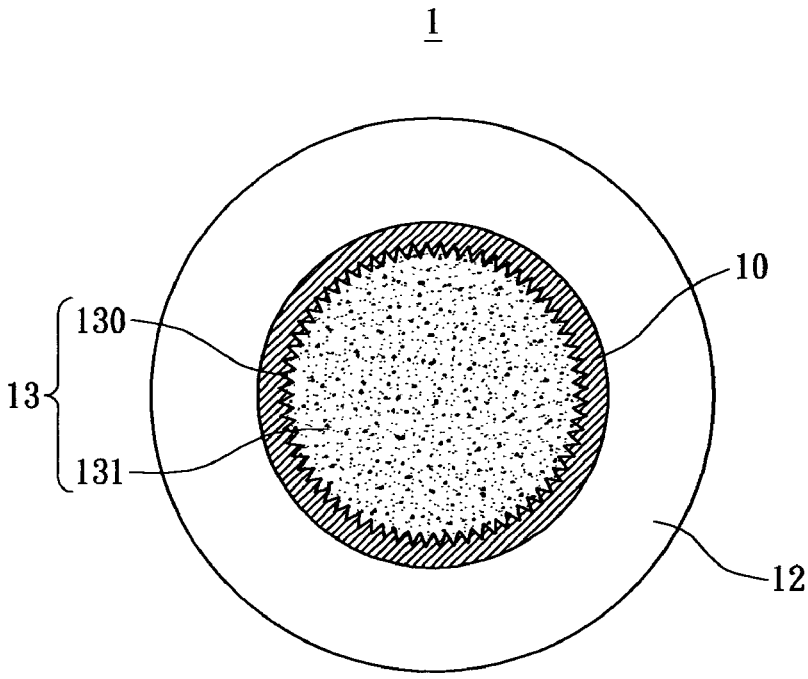
FIG. 5 is a cross sectional view along line 3—3 in FIG. 2 according to still another embodiment of the present invention.

Referring further to FIG. 3, the pipe member 10 includes a plurality of longitudinal grooves 130 radially arranged on an inner sidewall thereof. A wick structure 13 inside the heat pipe 1 includes the grooves 130 formed on the inner sidewall of the pipe member 10 and the sintered powders 131 attached to the inner surface 120 of the bottom lid 12. In this embodiment, each groove 130 has a dented rectangular shape in a cross sectional view along radial direction of the pipe member 10. However, in other embodiments as shown in FIG. 4 or FIG. 5, the shapes of the grooves 130 can be tapered or triangular. Since before the powders 131 is disposed on the inner surface 120 of the bottom lid 12 to be sintered, the powders 131 are small particles; therefore, the powders 131 can penetrate into each groove 130 at the connection. As such, the grooves 130 and the sintered-powder attachment 131 are combined together to provide excellent capillary effect and transmission of the heat pipe.

Figure 6:
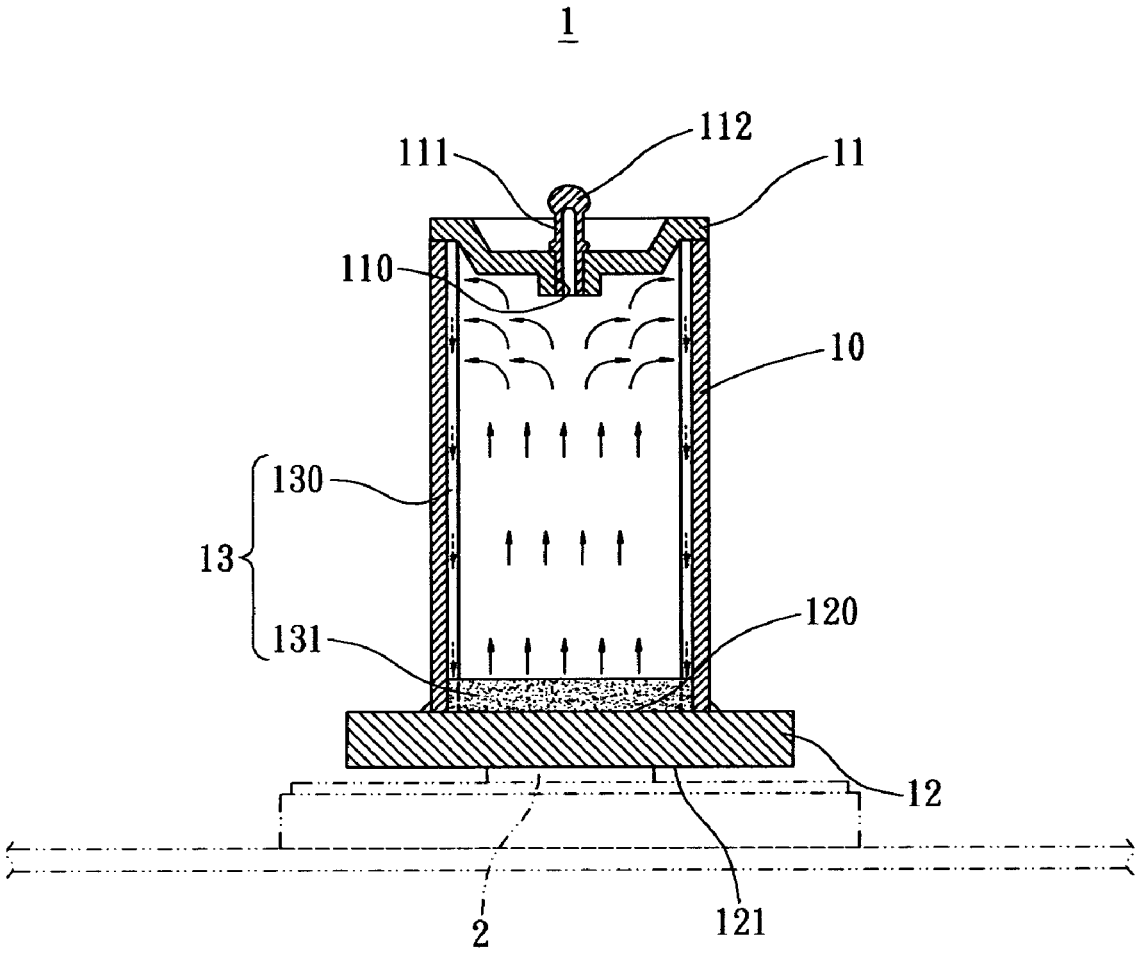
FIG. 6 shows the heat pipe of present invention in use.

FIG. 6 shows the heat pipe 1 of the present invention disposed on the heat source 2. The external surface 121 of the bottom lid 12 is contacted to the heat source 2. When the heat source 2 generates heat, the working fluid inside the heat pipe 1 will start to perform phase change. That is, the working fluid is vaporized to rise up to the top of the heat pipe 1 near the top lid 11, an then liquidized to flow down to the bottom of the heat pipe 1 near the bottom lid 12 along the axially formed grooves 130 of the pipe member 10. This phase change of the working fluid is continuously happened to transfer heat from the heat source 2.

Figure 7:
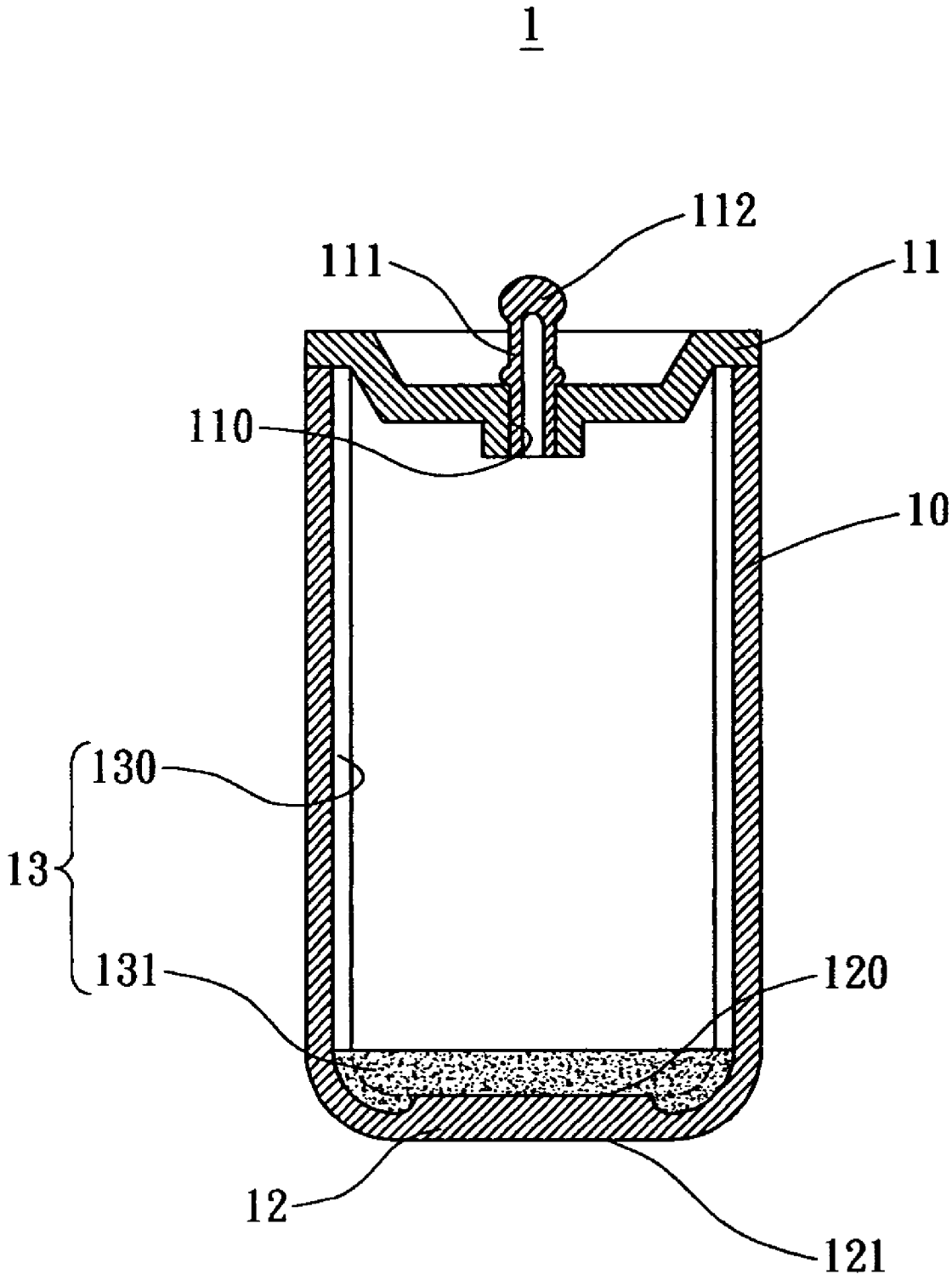
FIG. 7 shows a cross sectional view of a heat pipe according to anther preferred embodiment of the present invention.

Furthermore, in another preferred embodiment as shown in FIG. 7, the bottom lid 12 is formed integrally with the pipe member 10 so that the grooves 130 can be curvedly extended to the inner surface 120 of the bottom lid 12. Therefore, it provides more contact between the grooves 130 and the sintered powder 131 so that the transportation of the working fluid can be smoother to ensure the heat transferring effect.

Accordingly, the heat pipe 1 of the present invention includes a wick structure 13 combined by the grooves 130 and the sintered-powder attachment 131. The grooves 130 are formed on the inner sidewall of the pipe member 10, and the sintered powders 131 are attached merely to the inner surface 120 of the bottom lid 12. Therefore, an axial bar is no more needed for sintering the wick structure 13. Such that, the damage caused by removal of the axial bar are prevented and the fabricating process of the heat pipe is simplified.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A heat pipe comprising:

a pipe member with a plurality of longitudinal grooves radially arranged on an inner sidewall thereof;

a top lid covering a top end of the pipe member;

a bottom lid covering a bottom end of the pipe member where the bottom lid is a flat plate including a planar external surface to be contacted with a heat source; and a wick structure including the grooves and a sintered-powder attachment formed on an inner surface of the bottom lid, wherein the grooves are curvedly extended to the inner surface of the bottom lid.

2. The heat pipe as claimed in claim 1, further comprising a filling tube extending through the top lid.

3. The heat pipe as claimed in claim 2, further comprising a sealing structure sealing the filling tube.

4. The heat pipe as claimed in claim 2, wherein the top lid and the filling tube are integrally formed.

5. The heat pipe as claimed in claim 4, further comprising a sealing structure sealing the filling tube.

6. The heat pipe as claimed in claim 1, wherein the bottom lid is integrally formed with the pipe member.

7. The beat pipe as claimed in claim 1, wherein each groove has a dented rectangular shape.

8. The heat pipe as claimed in claim 1, wherein each groove has a dented tapered shape.

9. The heat pipe as claimed in claim 1, wherein the groove has a dented triangle shape.

10. The heat pipe as claimed in claim 1, wherein the sintered-powder attachment and the grooves are combined together.

11. A heat pipe comprising:

a pipe member having a top lid covering a top end of the pipe member and a bottom lid covering a bottom end of the pipe member, whose inner sidewall has a plurality of longitudinal grooves radially arranged, wherein the grooves are curvedly extended to an inner surface of the bottom lid; and a wick structure including the grooves and a sintered-powder attachment formed on the inner surface of the bottom lid.

12. The heat pipe as claimed in claim 11, further comprising a filling tube extending through the top lid.

13. The heat pipe as claimed in claim 12, further comprising a sealing structure sealing the filling tube.

14. The heat pipe as claimed in claim 12, wherein the top lid and the filling tube are integrally formed.

* * * * *